US006105338A

United States Patent [19]

Kalany et al.

[11] Patent Number: 6,105,338

[45] Date of Patent: Aug. 22, 2000

[54] CASE PACKER

[75] Inventors: Robert M. Kalany, Florence, Ky.; Ronald W. Schachleiter, Cincinnati, Ohio; John M. Paselsky, Ft. Mitchell, Ky.; Robert J. Burkhardt; Sima Paunesku, both of Cincinnati, Ohio; J. Daniel Greenwell, Florence, Ky.

[73] Assignee: R.A. Jones & Co. Inc.

[21] Appl. No.: 09/149,951

[22] Filed: Sep. 9, 1998

Related U.S. Application Data

[63] Continuation of application No. 08/932,349, Sep. 17, 1997, abandoned, which is a continuation of application No. 08/556,802, Nov. 2, 1995, abandoned.

[51] Int. Cl.[7] ..... B65B 35/40

[52] U.S. Cl. ..... 53/252; 53/251; 53/543; 198/475.1; 198/479.1

[58] Field of Search ..... 53/251, 252, 543, 53/566; 198/475.1, 479.1, 723

[56] References Cited

U.S. PATENT DOCUMENTS

| | | |
|---|---|---|
| 2,440,866 | 5/1948 | Malhiot . |
| 2,744,608 | 5/1956 | Ardell et al. . |
| 2,756,553 | 7/1956 | Ferguson et al. . |
| 2,873,565 | 2/1959 | Arneson . |
| 3,778,959 | 12/1973 | Langen et al. . |
| 3,899,069 | 8/1975 | Heinzer . |
| 3,956,868 | 5/1976 | Ganz et al. . |
| 4,380,283 | 4/1983 | van Maanen . |
| 4,693,055 | 9/1987 | Olsen et al. . |
| 4,756,139 | 7/1988 | LeBras . |
| 4,804,076 | 2/1989 | Pace . |
| 5,052,544 | 10/1991 | Anderson . |
| 5,501,064 | 3/1996 | Ingram et al. . |
| 5,502,950 | 4/1996 | Moncrief et al. . |

*Primary Examiner*—Daniel B. Moon
*Attorney, Agent, or Firm*—Wood, Herron & Evans, L.L.P.

[57] ABSTRACT

A case packer includes a mass flow conveyor moving containers in defined lanes and lane deflectors for urging containers laterally across the conveyor into a selectively actuable metering station. Containers are selectively metered into row groups of select count and segregated by transfer guides on an underlying transfer conveyor. The row groups are directed to move rearwardly or upstream on the forward moving transfer conveyor into alignment with an open case mouth. A rotary loader has extensible can pushers maintained in parallel with open case mouth during a substantial portion of movement of the cases past the rotary loader. This maintains the rows of cans in proper alignment for final case loading and prevents undesirable "A" pattern lock up. The transfer guides and rotary loader can be adjusted and/or modified to handle varied row counts of cans. The case packer is capable of full case run out, full final run out and automatic prime so there are no partially filled cases at the beginning or at the end of a run. Case sie changeover is facilitated.

14 Claims, 6 Drawing Sheets

"A" BRIDGING 6A
6A

CASE PACKER

This is a Continuation application of pending prior application Ser. No. 08/932,349, filed on Sep. 17, 1997, for CASE PACKER, now abandoned which is a Continuation of prior application Ser. No. 08/556,802, filed on Nov. 2, 1995, for CASE PACKER, now abandoned.

FIELD OF THE INVENTION

This invention relates to case packers and more particularly to apparatus for metering and transferring articles such as cans into a transport case.

BACKGROUND OF THE INVENTION

It is common to pack multiple containers such as cans or bottles into individual cases for shipment, storage or the like in varying configurations. Prior machines used for packing a plurality of cans, for example, into individual cases have, or face, a number of inherent problems. Such packing machines are generally used in large volume operations where thousands of cans must be conveyed, metered, separated, grouped and inserted into cases in the proper count orientation and at the high speeds demanded by producers. The cans are mass-fed and pressures of the mass-feed system and metering or counting stations must be handled without can damage and without adverse affect on the can handling systems downstream. Such pressures or the use of separating wedges and the like may unduly force cans into any can metering system, making the cans hard to separate, or may damage the cans. These pressures, in conjunction with can metering systems, may thus cause undesirable pulsations in the system, and can damage.

Another major problem in such systems is the tolerance of the system to emergency stops which can occur for numerous reasons, such as can damage, absence of a properly erected carton or case, downstream stoppage, jams and the like.

Still other significant problems arise in such systems in connection with start-up, carton run-out and full run-out modes of operation. When the systems are started, it is difficult to fully "prime" the system to fully fill the first cartons, thus initially producing a number of partially-filled cartons which cannot be sealed and shipped. Also, it is difficult to insure that all cartons at the end of the run will be filled. Finally, when it is desired to use up all cartons and cans in the system, it is difficult to end up with the last carton fully filled and no further cans in the intermediate metering or transfer system. In other words, it is difficult to prevent incomplete loads in the metering system on full run-out, with no empty cartons in the transport system.

Many of these difficulties are, of course, traceable back to the need to separate rows of cans into predetermined rows of select count groups for combination with other rows for proper grouping in a carton or case.

It is thus desirable, and one objective of the invention is, to provide an improved case packer capable of separating an intermediate metering function from the pressure of an infeeding mass of cans.

Another objective of the invention is, in a case packer, to minimize pressure on the cans when grouping is performed.

Another objective of the invention is to provide a case packer with no pulsation of cans in the feed or grouping areas.

A further objective of the invention has been to provide an improved case packer which is tolerant of emergency stops.

Another objective of the invention is to provide an improved case packer capable of fully loading the first case presented upon packer start-up.

Another objective of the invention has been to provide an improved case packer capable of fully filling a last carton to be filled without clearing the upstream infeed mass of cans, and without leaving cans in the metering stage of the packer.

A yet further objective of the invention has been to provide an improved case packer capable of accommodating a full case and can run-out so no cans will be left in the transfer and so no empty case will be left unfilled or partially filled.

In another aspect of the invention, it is desirable to introduce cans into cases or cartons in a particular pattern and thus to control the pattern so that no undesirable voids or spaces are left in the carton. Particularly, if the cans are not maintained in predetermined rows, properly oriented with respect to each other, the cans bridge or roll into a nestled, so-called "A" pattern lock-up configuration which will not permit all cans to be inserted into the case and it cannot be closed. Such occurs when three or four cans in one row, for example, nestle into the spaces between cans in an adjacent row so as to be staggered, with the row-ends out of alignment. This upsets the desired packing configuration as noted.

In the past, case loaders such as barrel loaders have been used to push a row, or a group of confined rows, directly into an open carton. The barrel loaders comprise a series of pushers conveyed in the direction of cartons being loaded but transversely selectively extensible to push a group of cans into cases. While this works, the extensive mechanisms, complexity, space requirements and cost of a barrel loader make it desirable to provide an improved loader.

One such different device is a rotary loader looking much like a gear wheel. A plurality of extensions are circumferentially spaced about a hub. The extension spacing and hub speed are correlated with cases to be loaded so the extensions rotate respectively into a position for pushing a group of cans into a respective open case moving in a straight line past the loader. The difficulty with such a device is that the can-pushing face of the extension is not parallel to the case mouth except at the instance when the case moves through a radial extending from the hub axis through the center of the hub extension. Thus the extension face engages the cans on an angle and other than parallel to the case mouth. This can allow cans to move out of a line parallel to the case mouth and cans might bridge or move into an undesirable "A" pattern lock-up type configuration where the rows of cans thereafter cannot be loaded fully into a case.

Accordingly, it has been a further objective of the invention to provide an improved loader for a case packer and which prevents cans in a row to be loaded from shifting along or out of the rows and causing an undesirable bridge or can lockup, preventing full loading of cans.

SUMMARY OF THE INVENTION

To these ends, one preferred embodiment of the invention includes, in a case packer, a channeling section for dividing cans on a mass flow conveyor into a plurality of rows or lanes, fixed lane diverting guides extending from each row for guiding rows of cans laterally across the mass flow conveyor to a metering station, a metering wheel associated with each row proximate the end of said fixed lane diverting guides for metering selected row group counts of cans into a row group guide, and a series of moving can transfer guides timed to segregate a row group of cans and providing tapered rear faces for guiding the row group, in cooperation with the row group guides, into a case or carton following the moving transfer guide.

Generally, there are provided as many can rows as there are rows to be packed in each case. While the following moving can transfer guides segregate one row group of cans from another from the same metering wheel, the moving can transfer guides do not push cans forwardly. Instead, the moving transfer guides, in cooperation with a transfer conveyor beneath the cans and the transfer guides, move the row group of cans rearwardly with respect to the transfer guides, down the rear faces of the can transfer guides to a position for loading in respective cases following the moving transfer guides.

In this regard, the cans are mass conveyed in rows atop one mass flow conveyor and then transversely across the mass flow conveyor and along the fixed lane diverting guides. The cans are then moved through a metering station and onto a transfer conveyor beneath the row group guides and carrying the moving transfer guides.

Each row group of cans is pushed into an open case by the pressure of the cans in the next downstream row group formed by the next downstream metering wheel. The last row group and the entire case fill is then finally transferred into the case, preferably by a rotary case loader as further described.

In summary, distinct rows of cans, the rows corresponding in number to the rows to be packed in each case, are moved transversely from a mass feed along an angled path and are metered into row groups of cans, each group consistent in a number with the number of cans in a row to be packed. Each row group is segregated by a moving transfer guide and is further urged transversely toward a case mouth following the moving transfer guide, where it is engaged by a succeeding row group pushing it into the case mouth. A final rotary loader pushes the final row group into the case mouth and transfers all row groups into the case for closure.

This embodiment produces numerous advantageous results. On start-up, the apparatus can be primed so that the first case through is fully loaded. Each row of cans is moved to its respective metering wheel and the first row group to be inserted in a case is timed to coincide with the first case, and so on. No partially-filled cases are produced or wasted.

Carton run-out can be accomplished without clearing the infeed can mass. A can stop associated with each meter wheel stops the cans so no more cans can be metered. This is timed so when the last case is fully filled, no more cans or row groups remain downstream of the metering stations on the transfer conveyor.

Finally, full run-out can be easily accomplished in preparation for a changeover at the end of a run. By sequentially stopping the flow of cans to the metering wheel, all cans on the mass flow conveyor constituting a full case load will be fed into the cases.

Moreover, it will be appreciated that all the infeed pressure is controlled by the can stop and by each associated metering wheel so no infeed pressure affects the row groups or the loading process. There is minimum pressure on the cans when the grouping occurs. There is a very smooth flow with no pulsation and the entire system is tolerant to emergency stops by control of the can stops positioned just upstream of the metering wheels in timed relation with the cases. Of course, the packer can include numerous fixed lanes and metering stations, but only the number corresponding to the number of rows to be loaded in a case is used when that size case is being filled.

In another aspect of the invention, a rotary loader is provided with an extensible can pusher, pivotally mounted and cam driven so the pusher extends to push against the last row group for each case and push all cans into the case. The pivotal mounting of the pusher makes it possible to maintain the pusher face essentially parallel to the case mouth throughout an extended linear portion of the case movement past the loader, thereby maintaining all cans in an appropriate orientation and preventing any bridging of cans, "A" pattern lock-up and improper loading or jamming.

All these and other advantages will become readily apparent from the following detailed description of a preferred embodiment of the invention, and from the drawings in which:

BRIEF DESCRIPTION OF THE DRAWINGS

FIG. 3A is a view similar to FIG. 3 but showing only two can guides in position for handling a row count of five cans;

DETAILED DESCRIPTION OF THE PREFERRED EMBODIMENTS OF THE INVENTION

It will be appreciated that the invention comprises a case packer for packing cases or cartons with various containers in preselected configurations. Such containers may be cans, bottles, or any other containers or articles suitably handled by the following apparatus. Accordingly, the term "containers", as used herein, encompasses containers and other cylindrical or spherical articles or items of other shape as will be appreciated.

As shown in the figures, articles of generally cylindrical or spherical configuration could be packed by the apparatus. Also, it is contemplated that articles of square or rectangular configuration or other configurations might be packed in the cases or cartons by the apparatus described herein.

Figures 1, 1A, 1B:
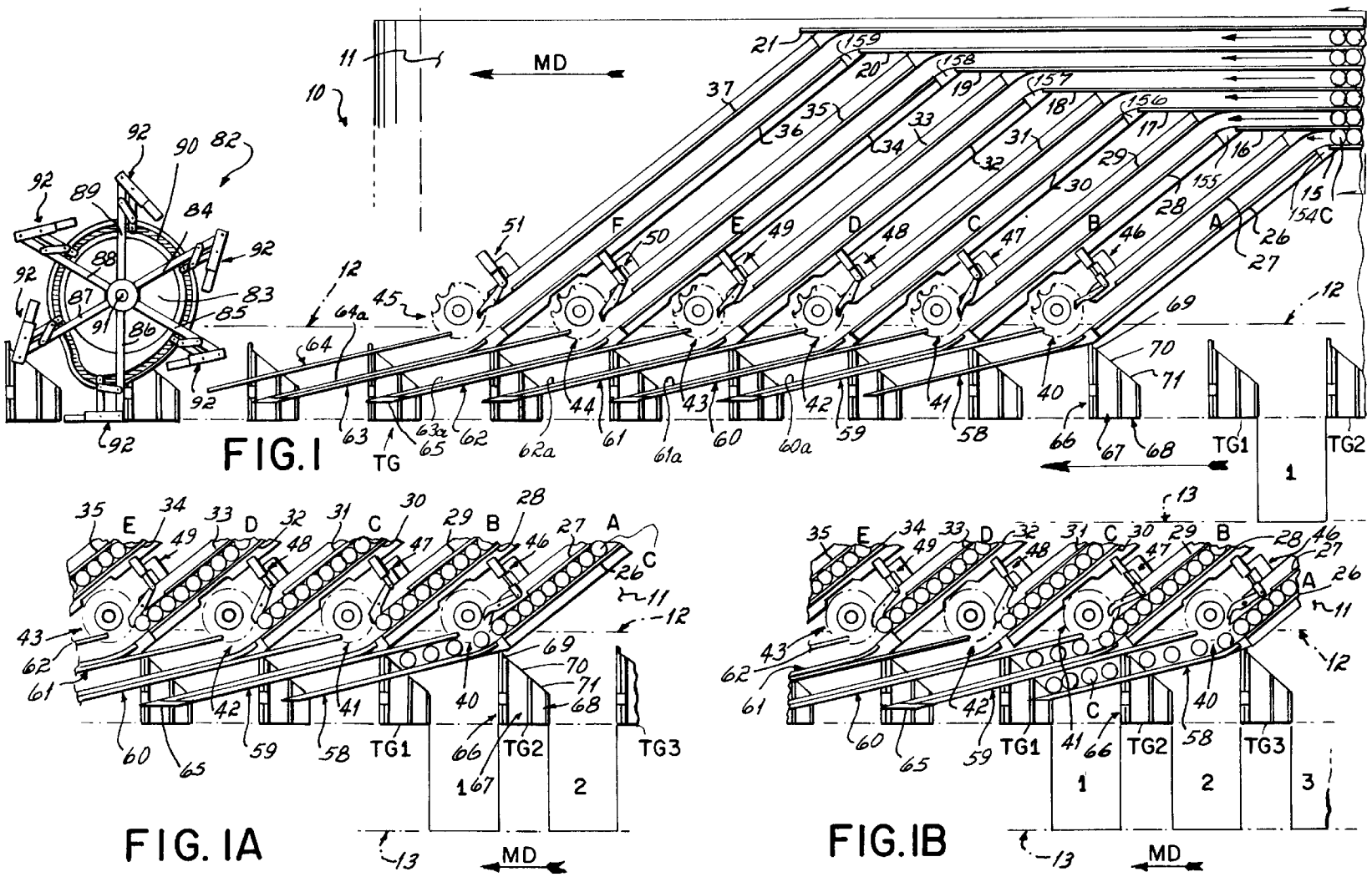
FIG. 1 is an illustrative plan view of a case packer according to the invention.
FIG. 1A is a view similar to FIG. 1 but illustrating start up of the packer.
FIG. 1B is a view similar to FIG. 1A showing a further step of the packer start up.
Figure 2:
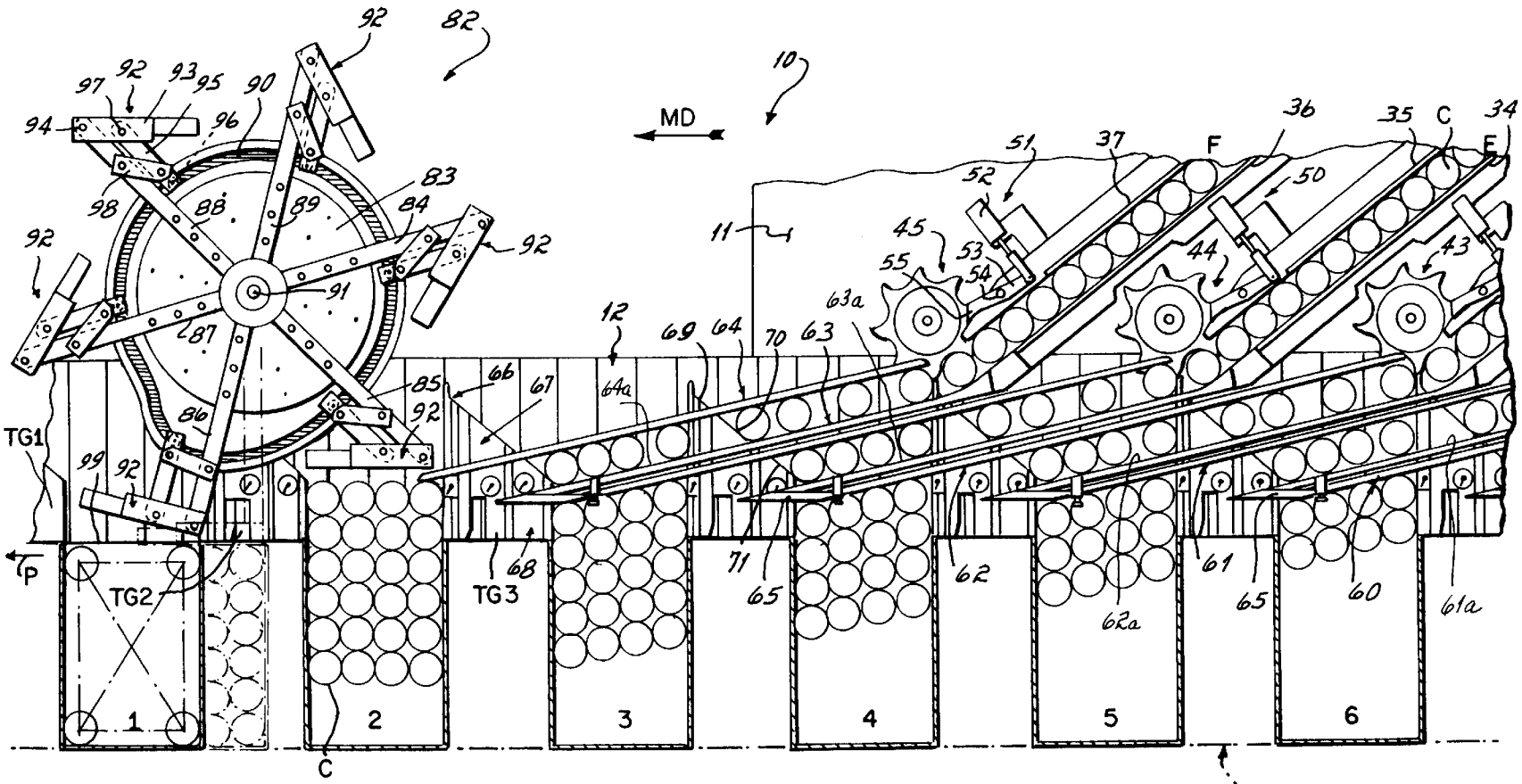
FIG. 2 is a plan view of the invention similar to FIG. 1 but illustrating loading of row groups of cans into cases, and illustrating further details of a rotary loader according to the invention.
Figure 3:
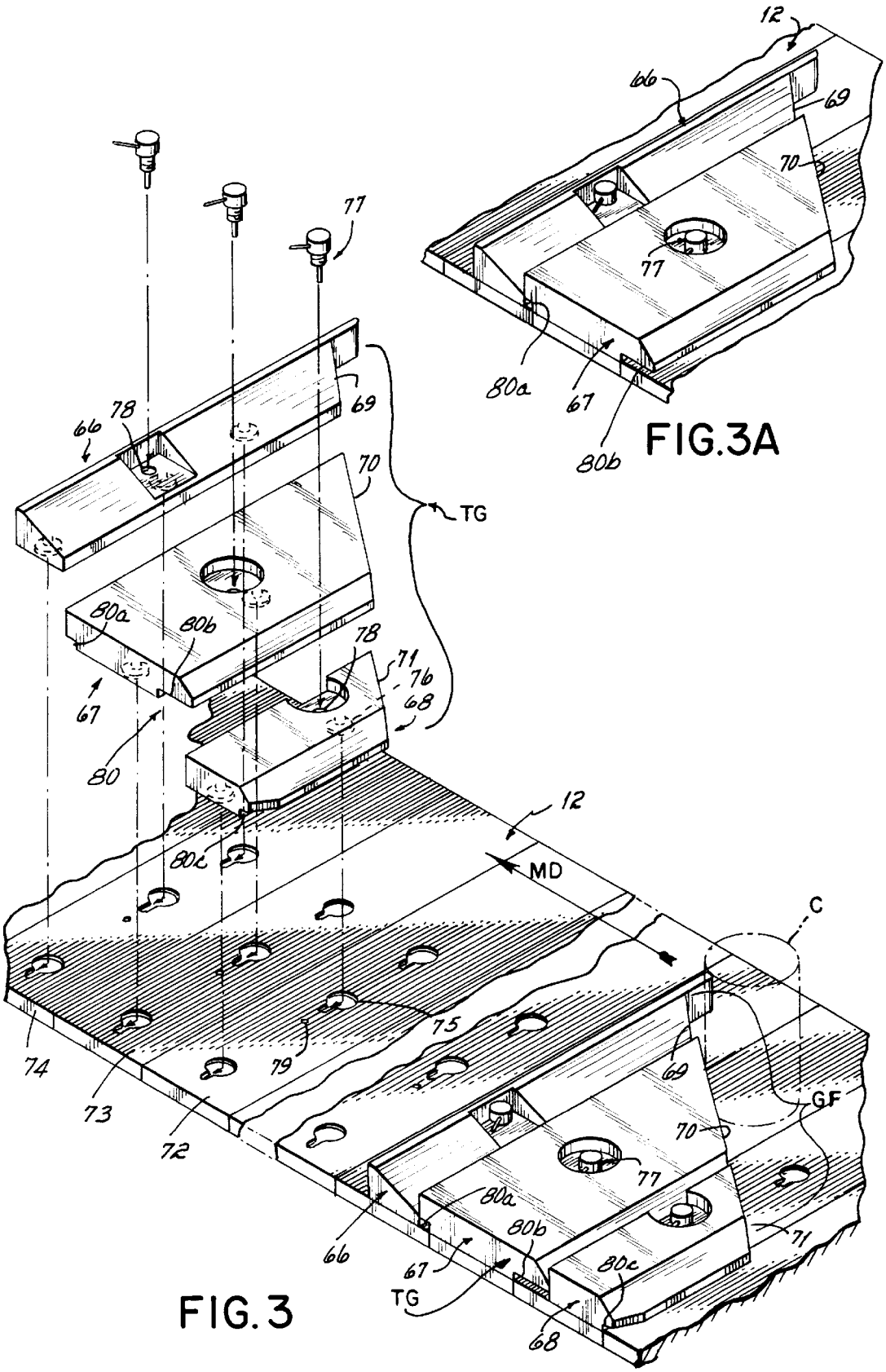
FIG. 3 is a perspective view illustrating mounting of the can guides according to the invention.

One case packer apparatus according to the invention is illustrated at 10 in FIG. 1. For purposes of illustration only, the apparatus will be described in a configuration for packing cans "C" into cases 1 through 6, as shown in FIGS. 1 through 3, and in the cases 100 through 103 will be described with respect to FIG. 4.

The case packer 10 includes a mass flow or feed conveyor 11 and a transfer conveyor 12. The mass flow conveyor 11 and transfer conveyor 12 are mounted side-by-side and move in a forward or machine direction indicated by the arrows "MD" in the figures. There is also provided a case conveyor 13 mounted on the other side of the transfer conveyor 12 from the mass flow conveyor for conveying cases in timed relation along the case packer, as will be described. Case conveyor 13 also moves cases in the linear machine direction "MD".

The case packer includes a plurality of lane dividers 15 through 21 for dividing a plurality of cans (C-A, C-B, C—C, C–D, C–E and C–F) into six lanes, each lane being defined between the lane dividers 15 through 21, respectively. The case packer further includes a plurality of fixed lane diverting guides 26 through 37. These guides respectively divert the cans "C" into six respective lanes A, B, C, D, E and F. Cans are thus referred to as C-A, C-B, C—C, etc., depending on the lanes they travel along.

Metering stations 40 through 45 are operatively disposed at the ends of lanes A, B, C, D, E and F, respectively. Each metering station comprises a metering star, such as a wheel with teeth, for engaging about a can and each wheel is capable, when rotating, of receiving a can from a respective lane and for metering or introducing the can into a downstream row as will be described.

Associated with each of the metering stations 40 through 45 are respective can stops 46 through 51. The details of the can stops are perhaps seen with respect to can stop 51. Each can stop includes a linear actuator 52, for example, operably attached to a can stop lever 53, pivoted at 54 to a portion of the case packer, such as to a fixed lane diverting guide 37.

Each can stop lever 53 has a can stopping end 55, which can be pivoted upon actuation of the actuator 52 into the path of the cans in the lanes A through F, for example, to stop the cans prior to engagement of the first can stopped by the star wheel of the metering stations 40 through 45.

Extending from the metering stations 40 through 45 are respective row group guides 58 through 64. These guides will serve to direct the cans in respective row groups formed by the respective metering stations, as the cans are moved toward the cases into which they are to be loaded, as will be described.

Mounted on the transfer conveyor 12 are a plurality of moving transfer guides, such as guides "TG" as shown in FIG. 1. The transfer guides "TG" are perhaps best shown in detail in FIG. 3. The transfer guide "TG" shown at the left-hand side of FIG. 3 is shown in exploded form for clarity. The guide is comprised of a plurality of members, preferably including first, second and third guide members 66, 67, 68 respectively.

Each guide member has a rearward guide face 69, 70, 71 respectively. When the guide is assembled to the transfer conveyor 12, the members 66, 67, 68 form by virtue of their faces 69, 70 and 71, a singularly, rearwardly extending guide surface. This guide surface extends rearwardly across the transfer conveyor 12, as clearly illustrated in the figures.

The lower right-hand portion of FIG. 3 illustrates the three guide members 66, 67, 68 forming a singular guide "TG" mounted on the conveyor 12 and showing the composite rearwardly extending guide face GF formed by the faces 69, 70, 71. A container such as a can is shown on the conveyor 12 in FIG. 3 for illustrative purposes to show the engagement of the can on the guide face GF, and particularly on the guide face 70 of guide member 67.

The transfer conveyor 12 is comprised of a number of transfer conveyor slats or buckets, such as slats 72, 73, 74, as shown in FIG. 3. Each of the slats is provided with a keyhole-shaped aperture 75. Each of the moving transfer guide members 66, 67, 68 have at least two downwardly extending bayonet lugs such as at 76, for example, for extending into respective aperture 75 in the transfer conveyor slat on which they are mounted.

Thus, it will be appreciated that each of the bayonet lugs of the respective guide members are inserted into the larger opening of the keyhole aperture 75 and the guide members thereafter move slightly sideways, so that the bayonet lug is securely disposed in the narrower portion of the keyhole slot 75.

Once the guide members are so positioned, a spring-loaded pin such as pin 77, for example, mounted on each guide, are extended through an aperture 78 into a lock hole 79 in the respective slat on which the guide member is mounted. This keeps the guide member 71, for example, from sliding to a position where the bayonet lug 76 could be released from the aperture 75. In this similar manner, each of the guide members 66, 67, 68 are secured to a respective slat of the conveyor 12, but are easily removable, as will be described later.

Figures 3B, 6A:
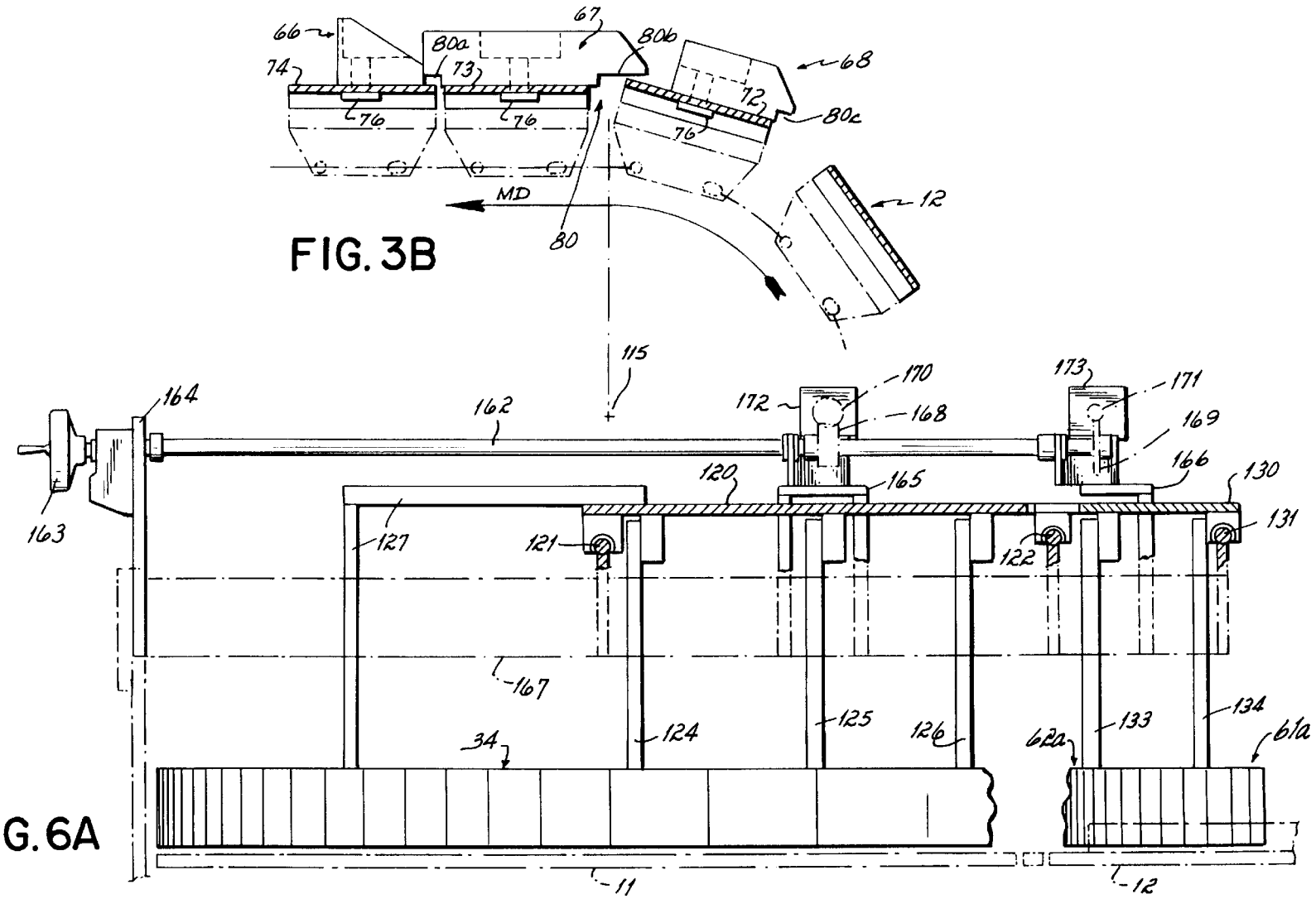
FIG. 3B is an illustrative elevational view showing an upstream end of the transfer conveyor with conveyor slats and transfer guides thereon.
FIG. 6A is a partial cross-sectional, broken schematic illustration viewed along lines 6A—6A of FIG. 6.

Each guide member is provided with a relief area 80, as necessary to accommodate motion of any transfer conveyor slat thereunder as the slats move around end stocks (FIG. 3B) defining the runs of the transfer conveyor. More particularly, it will be appreciated that the slats are flat and that their forward and rearward edges separate and move slightly outwardly when the slats are conveyed circumferentially about end stocks of the conveyor. This motion could cause the slat edges to contact the guide member mounted on an adjacent slat and cause noise, undue wear, and perhaps slat or guide damage. Accordingly, the guides are provided as necessary with elongated relieved areas 80 to accommodate slat edge motion through the end stock areas of adjacent slats underlying the respective guides. Preferably, as best shown in FIG. 3B, the relief areas 80*a* and 80*b* are formed in the leading and trailing edge of the secondary guide 67, which is relatively wide in relation to the other two guides and overlaps its own slat 73. Relief area 80 is formed in the trailing edge of the third guide 68, overhanging its slat 72.

Referring now specifically to FIG. 3B, it will be appreciated this is an illustrative elevational view of the upstream end of the transfer conveyor 12. As the slats 72, 73, 74 are carried around the axis 115 of the conveyor end stock (not shown) the slats separate and their ends move slightly radially outwardly of axis 115. If the transfer guides 66–68 were flat bottomed, those portions extending beyond the edges of the slats on which they are mounted might be hit by the leading or trailing edge of a slat as the slats move into and around axis 115. Accordingly, the relieved areas 80 accommodate such slat edge movement, and no interference of slats and guides is produced.

Returning now to FIGS. 1 and 2, for example, it will be appreciated that the respective row group guides 58 through 64 are located in a different plane than are the transfer guides "TG", so that the transfer guides "TG" may move past the row group guides without interference, each of the guides being able to engage the respective cans as will be described.

Moreover, it will be appreciated that each of the row group guides 58 through 64 is extended to a tapered end as shown in the figures, such as the tapered end 65 of row group guide 61 (see FIG. 2). The tapered end 65 could be mounted adjustably or optionally on its respective row group guide in order to slightly extend the guide to provide fine tuning of the case transfer mechanism.

Preferably, such tapered end 65 is removable and may be mounted to the case packer by means of any suitable bracket and thumb screw, for example, as illustrated in FIG. 2. In this regard, it will be appreciated that the end 65 might be removed for certain can sizes or for certain row counts. However, the guide extension provided by the ends 65 help to form the pack pattern or configuration of the cans of the row group as it departs the guide. The end 65 insures the can of a row group will remain under positive control until the next aligned can of a succeeding row group is in place to push it squarely into the case. This extension end 65 thus helps to prevent the undesirable "A" pattern lock-up which might occur if any can is left too free on the transfer for too long.

Figure 5:
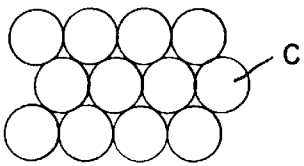
FIG. 5 is an illustration of an undesirable can "bridge" or "A" pattern orientation.

It is generally preferable to have the tapered end 65 extend to a point where, just as it disengages the first can in a row group of cans in a preceding group, the first can in the next succeeding row engages and pushes the first can of the preceding row, and so on, such that the cans are confined and pushed directly onto one another as the row of succeeding cans is pushed beyond the extended end 65 of the row group guide. The upper row of cans thus successively engages the row of succeeding cans, in order to maintain the cans in a preferred configuration, and in order to prevent the cans from jostling or coming out of orientation so as to produce an "A" pattern lock-up configuration bridge (FIG. 5). The configuration or orientation of the rows changes somewhat as the transfer process proceeds as will be described further herein.

Turning now to the details of the downstream end of the case packer, there is shown a rotary loader 82 comprising a disc 83 and a plurality of radially extending arms 84 through 89. A cam track 90 is disposed about the disc, which is rotationally mounted about an axis 91. Each of the arms 84 through 89 is of substantially the same length and each carries on its end an extensible can pusher mechanism 92, as will now be described.

Each can pusher mechanism includes a can pusher 93 pivotally mounted at 94, on an arm such as arm 88 as shown in FIG. 2. A cam follower arm 95 includes, at one end, a cam following pin 96 disposed in the cam track 90. The arm 95 is pivoted at 97 to the can pusher 93. A connector bracket 98 is pivoted between the cam follower arm 95 and the arm 88. Each of the can pusher mechanisms 92 is similarly constructed.

It will be appreciated that each of the cases 1 through 6, for example, as shown in FIG. 2, has an open mouth, such as mouth 99 shown with respect to case 1 at the left end of FIG. 2. It will also be appreciated that each of the case mouths 99 travel along a path indicated by the arrow "P" in FIG. 2, which passes the rotary loader 82 along a straight line lying in the same operable plane of rotation as the pushers 93, and preferably but not necessarily as the arms 85 through 89 and the disc 83 about the axis 91.

It will also be appreciated that the cam track 90 has a particular curvature, as shown by the shaded area in FIG. 2, to control the angle of the can pusher arm 93 with respect to its mounting arm which extends from the hub. In this regard, it will be appreciated that, as the pusher arm 93 is rotated about the axis 91, there is a relatively small angle between the respective mounting arms 85–89 and the pushers 93. However, as the mounting arms 85–89 move in a clockwise direction and approaches the path "P", the cam track 90 pushes against the cam pin 96, which pushes the cam arm 95 outwardly, away from the disc 83, and thereby extends the can pusher arm 93 to a position where it makes a greater angle with its respective mounting arm 85–89. Preferably, the cam track is designed such that the orientation of the can pusher arm 93 remains parallel with respect to the path "P" during an extended portion of the linear movement of the cases past the rotary loader 82.

At the same time, once the cans have all been pushed into a case, the cam track is oriented to quickly pivot the can pusher arm 93 back to its withdrawn position and away from the case mouth to allow for immediate downstream handling and maneuvering of the case flaps to a closed position.

It will be appreciated that as the cans are finally disengaged from the respective row group guides, and particularly from the final row group guides 64, that the cans are engaged by the can pusher arm 93 which is generally parallel to the open case mouth. This serves to push the cans directly perpendicularly into the respective cases and does not allow the cans to move with respect to each other, so that they might form themselves into an undesirable "A" pattern lock-up or bridging orientation (FIG. 5), which would shift one of the rows slightly outwardly of the case walls. This would make it very difficult, if not impossible, to load that particular row into the case. Accordingly, the orientation of the pusher face 93 in a parallel configuration with respect to the case mouth through a substantial linear portion of the movement of the cases past the rotary loader 82, guarantees that the can row groups will be squared up and pushed perpendicularly and squarely into the cases for the desired final load configuration.

Figure 4:
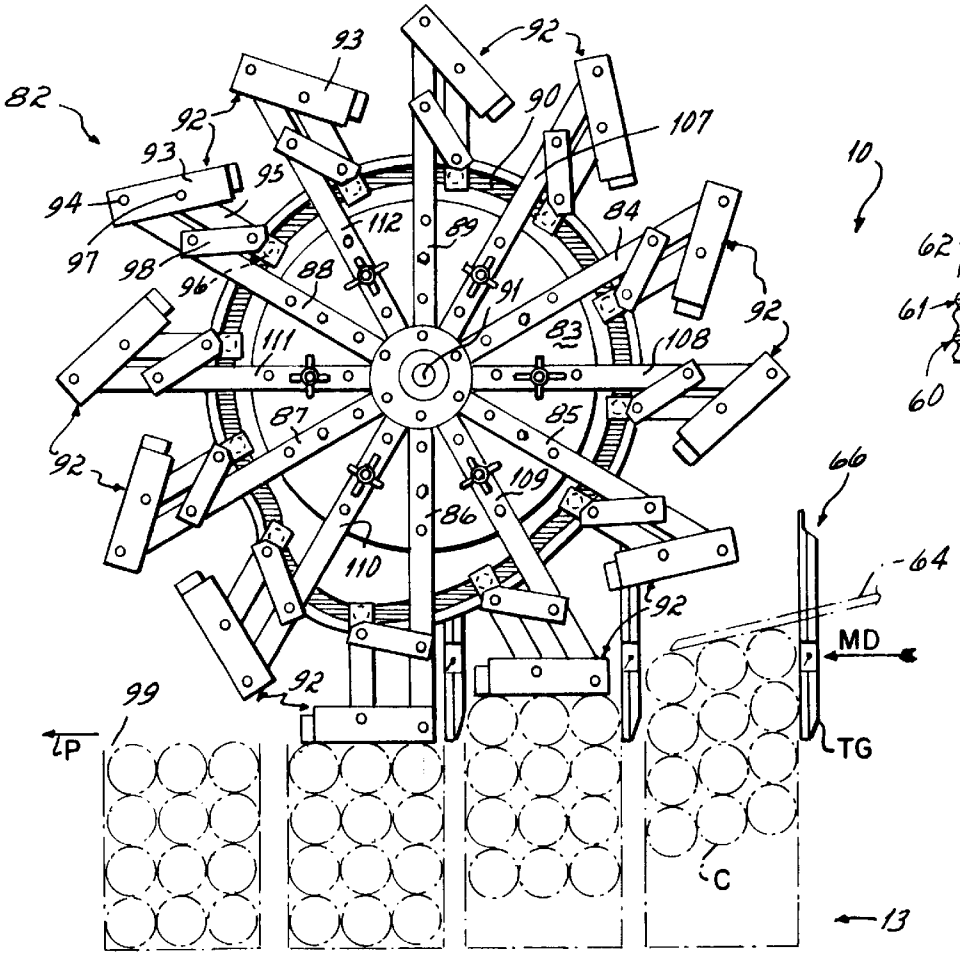
FIG. 4 is a plan view illustrating details of a rotary loader according to the invention but showing the loader set up to handle loading a different row group can count case.

Turning now briefly to FIG. 4, there is illustrated therein an alternative embodiment of the rotary loader 82 for feeding cases, such as cases 100 through 103, with a row group of a differing number of cans, such as three cans for each row, as opposed to the four can rows shown in FIG. 2.

In the embodiment shown in FIG. 4, the rotary loader 82 has been outfitted with an additional six arms 107 through 112, which are removably affixed to the disc 83. As will be further described in the embodiment shown in FIG. 4, the case packer has been reconfigured to load cans into cases wherein each row group has three cans rather than the four cans shown in the other figures.

In this regard, the pitch of the cases 100 through 103, i.e. their spacing on the case conveyor 13, can be substantially decreased. With this decrease in pitch, it is desirable to add the additional pusher support arms 107 through 112, together with associated pusher mechanisms on each of such arms, for handling the packaging of the final row groups into the cases on a decreased pitch basis, without requiring the six arm rotary loader as shown in FIGS. 1 and 2, for example, to be driven at a much higher speed.

Accordingly, the rotary loader 82 can be modified to include any suitable number of arms and can pushers so that the rotary loader can be accurately timed with respect to the particular cases to be filled and their speed past the rotary loader, as will be appreciated.

Turning now to the operation of the embodiment illustrated in FIGS. 1 through 3, it will be appreciated that a plurality of cans are divided into lanes, as shown in the top right hand corner of FIG. 1. These cans are moved in a machine direction "MD" by the mass flow conveyor 11 to the point where the lanes are diverged across the mass flow conveyor 11 by means of the respective lane diverting guides 26 through 37, which define and maintain the lanes A through F as will be appreciated.

Thus, as the cans are conveyed in a machine direction by the conveyor 11, the respective lane diverting guides 26 through 37 operate to guide the cans laterally across the conveyor 11 and toward the transfer conveyor 12 and, as well, into the respective metering stations 40 through 45.

Until cases are present on the case conveyor 13, the cans are all held just upstream of the metering station by the respective can stops 46 through 51. That is to say that each of the linear actuators 52 associated with each can stop have been retracted to pivot the end 55 (FIG. 2) of each can stop into the lanes A through F, respectively, to thereby prevent the cans from being picked up by the metering wheels of each metering station 40 through 45. Only when a case, such as case 1 as shown in FIG. 1, is presented on the case conveyor, are the can stops selectively actuated to permit priming of the transfer system. The "transfer system" is that area of the case packer comprising or defined by the transfer conveyor 12, for example, to be filled with the cans in a manner as will be described.

Particularly now referring to FIG. 1A and 1B, it will be appreciated that these figures show the upstream portion of the case packer, which is illustrated in FIG. 1. In each of FIGS. 1A and 1B, there are shown lanes A through E of the cans which are diverted across the mass conveyor 11. With respect to FIG. 1A, it will be appreciated that case 1 has been conveyed to the position as shown, such that the transfer guides TG1 precedes the case 1, and the transfer guide TG2 trails the case 1.

It will be appreciated that the can stop 46 has now been released, such that the metering station 40 has passed four cans and directed them between the row group guides 58 and 59, where they are also moved onto the transfer conveyor 12. The motion of the transfer conveyor 12 moves the cans in a direction "MD" toward the transfer guide TG1, which is also moving with the conveyor 12. At this time, it will be appreciated that the downstream can stops 47, 48, 49, 50, 51 have not yet been actuated and still hold the cans in the lanes B through F.

Turning now to FIG. 1B, it will be appreciated that the case 1, together with the following cases 2 and 3, have progressed in the machine direction. Also, it will be appreciated that the can stop 47 has been selectively actuated to release the cans so that the metering station 41 has separated a four can row group from lane B and introduced them between the row group guides 59 and 60.

During this time period, and along with the movement of the case 1 by the case conveyor 13, another row group of four cans as shown in FIG. 1B, has been formed by the metering station 40 between the row group guides 58 and 59, and this other row group of four cans has been disposed between the transfer guides TG1 and TG2.

As the cans are urged laterally across the transfer conveyor 12, the first can, i.e. the left-most can in FIG. 1B, has been urged against the rear face GF (FIG. 3) comprised of faces 69, 70 and 71 of the transfer guide TG1. The combined orientation of the transfer guide 59, together with the faces 69, 70, 71, and the motion of the transfer conveyor 12, serves to move the row group of cans rearwardly (i.e. upstream) with respect to the guide TG1.

At the same time, a leading edge of the transfer guide member 66 of the transfer guide TG2 as shown in FIG. 1B, has moved up into the row group pathway defined between the row group guides 58 and 59 to segregate four cans into the row group as shown just above case 1.

Accordingly, a row group of a preselected count of four cans is formed. At the same time, it will be appreciated from FIG. 1B that a second row group of four cans is being formed immediately alongside case 2. The following transfer guide TG3 is just coming into a crossing position with respect to the row group guide 58 and will segregate the second row group of four cans, just laterally with respect to case number 2.

As noted, at the same time as illustrated in FIG. 1B, the can stop 47 has been opened so that another row group begins to form between the guides 59 and 60. That row group will form the second row of cans, which is to be inserted into case 1. As the cases move along, the can stops are progressively activated to prime the transfer conveyor so that, by the time the first case 1 has reached its position as illustrated in FIG. 2, a plurality of rows of cans have been formed and inserted into the case.

It will be appreciated that, in this embodiment described, there are twenty-four cans to be inserted into each case. These comprise six row groups of four cans each and it will be appreciated that the number of rows to be inserted into each case, correspond to the number of lanes of cans A through F.

It will be appreciated that many different can counts and configurations can be inserted into cases and that, generally, the number of lanes used to feed cans between the row group guides correspond in number to the rows of cans which are to be inserted into each case. The number of cans in each row, of course, will be determined by the operation of the metering stations 40 through 45 and the pitch or spacing of the transfer guides "TG" and, as well, of the cases as they are moved along, between and following the respective transfer guides.

It will also be appreciated that as the cans are segregated into row groups and moved along by the transfer conveyor 12, the cans are moved into an abutting position with respect to the rearwardly directed faces GF (69, 70, 71) of the respective transfer guides, so that the cans are actually moved rearwardly on the forwardly moving transfer conveyor 12, to a position where the row group is aligned laterally with the open mouth of the respective case into which it is to be formed. This occurs with respect to each of the row groups as it is conveyed along the transfer conveyor 12 and finally into a position above a preceding row group for insertion into the cases.

The row groups of cans are preferably oriented in a square pack pattern configuration (i.e. the row group is parallel to the direction of travel) as the rows leave the effective ends of the row group guides. However, as the cans in each row move past the tapered end 65 of its respective row group guide, the aligned can in the next succeeding row group presses on the preceding can and pushes it into the case. This causes the cans in each row to form dynamically an inclined or staggered row as each can in a row is pushed into the case by a can in a succeeding row. For illustration, in FIGS. 2 and 4, the can rows are shown slightly inclined in the case. This configuration is caused by the successive engagement of each succeeding can on a can in a preceding row and the continued pushing of the succeeding can by its own row group guide. Such inclination of the row groups by this sequential can pressing are not gross enough to permit the cans to go into an "A" pattern lockup or any non-conforming or undesirable configuration. Thus, the "load" in each case continually undergoes a dynamic shuffling from a square to a slightly inclined configuration as successive rows are formed and pushed by the row group guides toward the case.

When the cases pass the last effective row group guide, i.e. 64 in FIG. 2, the last can in the last row is finally pushed toward the case by the row group guide end so all cans and row groups are in a square pack pattern. See case 2 in FIG. 2. These cans are then moved into operative relation with the rotary loader 82. The can pushers of the loader 92 engage the rows in a condition generally parallel to the mouth of the case, holding them in a square pack pattern, transferring and conforming them into the case, thus filling the case with the final square pack configuration (see FIG. 4).

Of course, in FIG. 2, if only five row groups are formed, for example in a 20-pack case, the last end 65 of row group guide 63 would be the guide finally orienting the row groups in a square pack pattern configuration, and so on, back upstream as varied numbers of row groups are formed for particular cases.

The center lines of the cans on each row and the end cans of each row, are illustrated by the rectangular phantom lines shown in FIG. 2 with respect to case 1. In addition, the diagonal dimension (also in phantom lines) of the first and last cans respectively of the first and last rows inserted into the case, is consistently maintained.

Also, it will be appreciated that the gentle let off of the tapered row group guides with respect to the rows and the immediate succession of each can in each succeeding row on top of a respective can in a preceding row, maintain the cans in a position where they can be finally packed, as illustrated in the drawing, without relaxing or resorting into an "A" pattern lockup, such as that illustrated in FIG. 5.

It will be appreciated that if the rows were to relax into this configuration, the lateral dimension of the case would be exceeded and it would be impossible to pack the rows into the cases. Pushing such orientation rows directly laterally into a case would cause a jam by the cans extending outwardly of the case mouth.

Figure 1C:
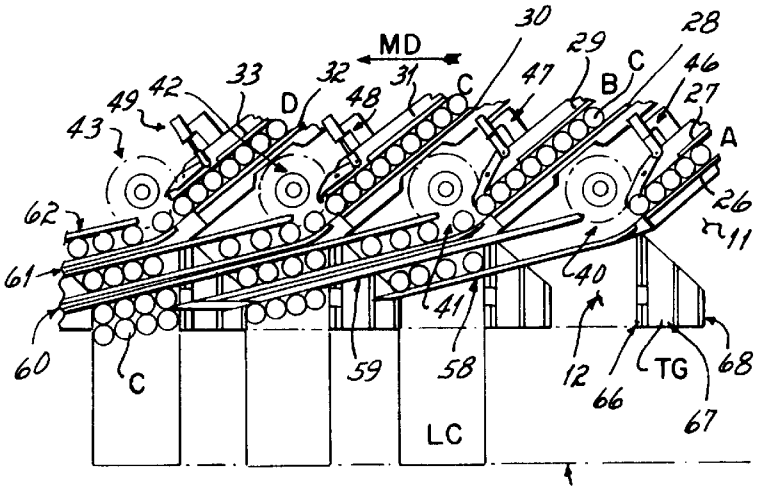
FIG. 1C is a view similar to FIG. 1B but illustrating the end of a case filling run.

Turning now to FIG. 1C, there is illustrated a runout configuration of the invention, wherein it is desirable to fully fill the last case in a case run and leave no cans on the transfer system, that is, between the metering stations and the case conveyor, for example, which would have to be wasted or reinserted into the mass flow system. :n this regard, it will be appreciated that as a last case "LC" is moved down the case conveyor 13, the respective can stops 46 through 51 are actuated to block the flow of cans to the respective metering stations. Accordingly, for example, as the last case "LC" approaches the case packer, the first row group to be loaded into the case is formed and thereafter the can stop 46 is actuated to block lane A from further feeding cans between the row group dividers. As the case moves further down the line, the can stop 47 is actuated to block further cans and, in this manner, the last row group of cans metered by each successive metering station is fully inserted into the last case "LC" and no further cans remain between any respective metering station and the case conveyor 13. The system can thus be shut down and again restarted as illustrated in FIGS. 1A and 1B and as described above, so that there are no loose cans in the transfer system.

It will also be appreciated that it is possible to place, in the system and within the mass-flow conveyor, further can stops and metering stations which would count the cans going into the lanes described above, so that the entire case packer can be stopped without any cans in any portion of the transfer system, thus allowing for changeover to different product, etc.

It will also be appreciated that the invention can accommodate situations where a case is absent, such as where a case is not in a filling position or where an unacceptable case for filling is presented in the can conveyor. Under such condition, the flow of cans through the metering systems of each lane or row can be sequentially stopped and then started so no incomplete loads of cans are formed. Stoppage after each metering station is for the duration of time in which that station would have the absent case. Metering is then sequentially resumed so row groups of cans are formed for following cases, all without shut-down of the system. In this way no load or rows of any cans are formed in the system corresponding to the position of the missing or unacceptable case. Accordingly, a missing or unacceptable case will not require the system to be shut down, except for removal of a damaged or unacceptable case by an operator, and system operation will continue normally with the exception of a sequential stop/start in the metering of each lane.

Turning now to FIG. 4, it will be appreciated that the construction of this alternative rotary loader for the case packer has already been described. It will further be appreciated that the case packer can be adjusted to handle varied row counts. For example, as illustrated in FIG. 4, the transfer guide members 67, 68 have been removed, leaving only the guide member 66, which has a small rearwardly inclined face 69. In this regard, it is desirable, for example, to change the row count from four cans to three cans. In order to accomplish this as noted, the transfer guide members 67, 68 have been removed, leaving only the transfer guides 66. Extra transfer guides 66 are also mounted on the conveyor to the desired case pitch, wherein the cases are now moved closer together, i.e. doubled, for example. Accordingly, the transfer guides "TG" comprise only the transfer guide members 66 and the operation of the packer is essentially the same, as previously described, except the row groups are in counts of three. It will be appreciated that additional transfer guides are placed between the guide 66 positions, in a four count row, such that there are now, in effect, 6 cans per original pitch with each 3 can row at ½ pitch spacing.

It is also possible, for example, with a similar case packer, to load cases where each row count comprises five cans, for example. This is accomplished by removing only the third guide member 68 to accommodate a fifth can in each row group. Otherwise, the operation is as previously described, with the metering stations and the guides cooperating to handle row groups of five.

For changes in the numbers of cans in a row group, for example, it will also be appreciated that the ratio of the drive of the star metering wheels may also be accordingly changed to accommodate the different can count. For example, four cans are metered per nominal pitch (i.e. distance between transfer guides) when there are to be 4 cans per row group. When the apparatus is changed over to produce 3 cans per row group, the transfer guides 67, 68 are removed and extra transfer guides 66 are added on ½ nominal pitch increments since the case positions are also doubled or moved to ½ original case pitch. In this instance, the star metering wheel drive ratio is changed so that the metering station meters 6 cans per nominal original pitch or 3 cans per ½ pitch or case. The star metering wheels are preferably driven by a servo motor which is pre-programmed with the various desired ratio changes. Otherwise, drive ratios are changed by changing sprockets, pulleys or by any suitable adjustable power transmissions.

For 5 cans per row group, the metering star wheel drive ratio is changed to produce 5 cans per nominal pitch, and so on.

In another aspect of the invention, it will be appreciated that the apparatus described above can be made to accommodate cans of differing diameter quickly and without requiring a large amount of change-over parts. Essentially the invention thus further contemplates adjustably mounting the lane dividers 15–21, the lane diverting guides 26–37 and the row group guides 58–64. Also, the loader arms 107–112 and pusher arms 93 can be added or deleted as desired for the desired can count.

Figures 6, 7:
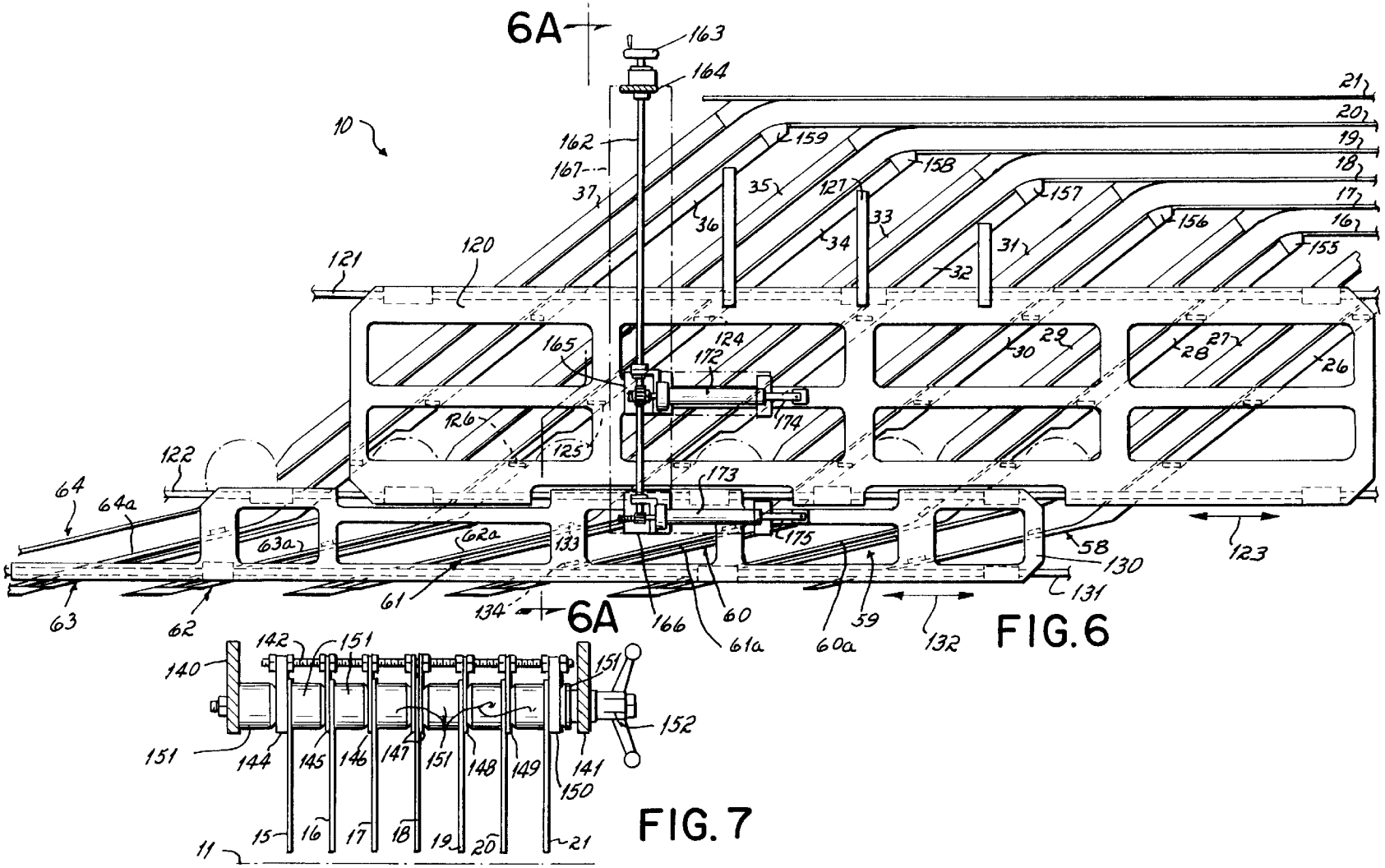
FIG. 6 is a plan view similar to FIG. 1 but showing certain details of the mounting and adjustment apparatus for can size change.
FIG. 7 is an elevational cross-section view illustrating mounting of the parallel lane guides.

More particularly, FIGS. 6, 6A and 7 illustrate one embodiment of the adjustable mounting of the dividers 15–21, guides 26–37 and guides 58–64. With reference to FIG. 6, it will be appreciated that lane diverting guides 26, 28, 30, 32, 34 and 36 are mounted on an adjustable plate 120. Lane diverting guides 27, 29, 31, 33, 35 and 37 are fixed on apparatus 10. Plate 120 is slidably mounted on ways 121, 122 (FIG. 6A) for reciprocating motion in the directions indicated by double ended arrow 123. Downwardly depending brackets 124, 125, 126 and 127 mount the movable guides 26, 28, 30, 32, 34 and 36 on plate 120 for movement with plate 120.

Guide 34 is shown, for example, in FIG. 6A with brackets 124, 125, 126 and 127 schematically shown holding the guide. It will be appreciated that FIG. 6A is schematic with numerous elements omitted for clarity and explanation. Outboard brackets such as bracket 127 also are used to support the ends of guides 32, 34 and 36, as necessary, to plate 120. It will be appreciated that each of the movable guides 26, 28, 30, 32, 34 and 36 are similarly mounted to plate 120, and that as plate 120 is reciprocated in the directions of arrow 123, the movable lane diverting guides 26, 28, 30, 32, 34 and 36 are moved in the same direction, i.e. obliquely to the direction of extension of each such guide. This motion widens or narrows the gap between each respective movable guide 26, 28, 30, 32, 34 and 36 and its respective fixed guide 27, 29, 31, 33, 35 and 37 to accommodate cans of bigger or smaller diameter.

In a somewhat similar fashion, the row group guides 58–64 include at least one movable row group guide 58, 60*a*, 61*a*, 62*a*, 63*a* and 64*a* to guide the transfer group or row group of cans.

Each of the movable row group guides 58, 60*a*, 61*a*, 62*a*, 63*a* and 64*a* are mounted to plate 130 mounted for sliding reciprocal movement on ways 122 and 131. Plate 130 is movable in reciprocal directions indicated by double arrow 132 (FIG. 6).

Brackets, such as brackets 133, 134 depend to hold the movable row group guides on the plate 130 for movement therewith. Thus, as plate 130 moves in the reciprocal directions of arrow 132, the movable row group guides 58, 60*a*, 61*a*, 62*a*, 63*a* and 64*a* move in the same direction obliquely to the direction of extension of each such guide. This widens or narrows the guide spacing for the row group to accommodate cans of bigger or smaller size. It will be appreciated that due to the differences in angular extension of the lane diverting guides on the one hand and the row group guides on the other, plate 130 will have to move further in one of its reciprocal directions (132) than plate 120 in its direction (123) to accommodate a change in a can diameter.

Lane dividers 15–21 are mounted to packer 10 via frame members 140–141, screw 142 and brackets or spacers 144–150 (FIG. 7). These spacers are size specific lane spacers which are replaced as the can diameters change. While screw 142 is shown in FIG. 7, it will be appreciated numerous ones of these are provided along the packer 10 for mounting the lane dividers by such brackets or spacers 144–150, as needed. The various brackets or spacers have upper ends interconnected with screw 142, and are spaced apart, by nominal spacers 151 used with all can diameters. Handle 152 is used to facilitate adjustment and holding of the lateral disposition of the lane dividers.

Divider 18 is preferably fixed laterally. Thus, as can size changes are made, bigger or smaller spacers are used to widen or narrow the can lanes.

As the lane dividers 15–21 are moved, or as the lane diverting guides 26, 28, 30, 32, 34 and 36 are moved, the junction of the respective dividers and guides will be affected. To assure smooth transition of cans, adjustable or replaceable couplings 154–159 are used to accommodate movement of the lane dividers and movable lane diverting guides with respect to each other. These couplings may take any suitable form.

It will be appreciated that the metering star wheel recesses are generally large enough to accommodate a large range of can sizes. The wheels could also be changed to accommodate can size changes.

Considering now the adjustment of the lane diverting guides and row group guides, reference is made to FIGS. 6 and 6A. Plates 120 and 130 are mounted to a common drive bit at different ratios. This is to produce the greater motion necessary for plate 130 to correspond the change in size of the path provided by the movable row group guide with that lane size provided by movement of the movable lane diverting guides. To this end, a single drive rod 162, rotatable by wheel or crank 163, is rotationally mounted on frame members 164, 165, 166 to packer 10 via packer frame member 167 shown in phantom in FIG. 6A. Gears 168, 169 are fixed to rod 162. Gears 170, 171 are coupled to linear actuators 172, 173 respectively. These actuators each include an extensible-retractable piston 174, 175 attached respectively to plates 120, 130. As rod 162 turns, gears 168, 169 drive gears 170, 171 in respective operable contact. The ratios of the gears are selected to that when plate 120 moves a defined lineal extent to produce a predetermined can lane width with the lane diverting guides 26–37, then plate 130 is moved a greater lineal extent to produce a corresponding lane width between the respective row group guides 58–64. For example only, gear 168 may have 10 teeth and gear 170 have 9 teeth, while gear 169 has 60 teeth and gear 171 has 20 teeth. For the respective angles of the lane diverting guides and the row group guides to the machine direction, this ratio will produce a cooperative, corresponding lane width change between the lane diverting guides 26–37 and the row group guides 58–64. Of course, varied angles of guides and different ratios could be used.

It will be appreciated that the adjustable tapered ends 65 of the row group guides may also be adjusted to accommodate changes in the lane widths.

In this way, it will be appreciated that packer 10 can handle cans or objects of varied size requiring lane width changes, and with very little changeover parts and time required.

These and other modifications and variations will be readily apparent to those of ordinary skill in the art without departing from the scope of the invention and applicant intends to be bound only by the claims appended hereto.

What is claimed:

1. A rotary loader for pushing rows of containers into cases, said loader comprising:

a disc mounted for rotation on an axis;

loader arms extending from said disc;

a container pusher mounted on each arm and having leading and trailing ends with said trailing ends being respectively pivoted to said arms;

a cam follower pivoted to each arm; and a cam disposed about said disc;

wherein when said disc turns about said axis, said pushers are moved in a plane about said disc and said cam and cam follower urge said pushers from a first position on said arms about their pivoted ends respectively into a parallel position with respect to a predetermined straight path offset from said axis and over a portion of travel of said pushers in said plane.

2. A rotary loader as in claim 1 wherein:

said straight path comprises a path of movement of the open mouth of a container past said loader, said pusher being oriented for pushing a row of containers into said case mouth perpendicularly to said case.

3. A rotary loader as in claim 2 wherein said cam and cam follower pivot said respective pushers away from said row of containers immediately after pushing a row into said case mouth.

4. A rotary loader as in claim 1 wherein said pushers extend from said arm at an angle dependent upon the rotary position of said pusher with respect to said axis and said cam, said angle increasing during movement of said pusher in said parallel position along said portion of travel.

5. A rotary loader as in claim 1 wherein the number of arms and pushers is variable to accommodate varied numbers of container counts in a row.

6. Apparatus as in claim 1 wherein said pushers have a can engaging face and wherein each said can engaging face is flat throughout its length.

7. Apparatus as in claim 1 wherein said cam is oriented to positively retract said pushers to said first position.

8. A rotary loader for pushing rows of containers into cases, said loader comprising:

a hub mounted for rotation on an axis;

a plurality of loader arms extending from said hub;

a plurality of container pushers pivoted at rear ends thereof to said loader arms respectively;

a cam follower pivoted to each arm; and a cam disposed about said hub;

wherein when said hub turns about said axis, said pushers are moved in a plane about said hub and said cam and cam follower pivot a forward end of said pushers respectively about their rear ends and move said pushers from a first position on said arms into a parallel position with respect to a predetermined straight path offset from said axis and over a portion of travel of said pushers in said plane.

9. A rotary loader as in claim 8 wherein:

said straight path comprises a path of movement of the open mouth of a container past said loader, said pusher being oriented for pushing a row of containers into said case mouth perpendicularly to said case.

10. A rotary loader as in claims 9 wherein said cam and cam follower pivot said respective pushers away from said row of containers immediately after pushing a row into said case mouth.

11. A rotary loader as in claim 8 wherein said pushers extend from said arm at an angle dependent upon the rotary position of said pusher with respect to said axis and said cam, said angle increasing during movement of said pusher in said parallel position along said portion of travel.

12. A rotary loader as in claim 8 wherein the number of arms and pushers is variable to accommodate varied numbers of container counts in a row.

13. Apparatus as in claim 8 wherein said pushers have a can engaging face and wherein each said can engaging face is flat throughout its length.

14. Apparatus as in claim 8 wherein said cam is oriented to positively retract said pushers to said first position.

* * * * *

UNITED STATES PATENT AND TRADEMARK OFFICE
Certificate

Patent No. 6,105,338 Patented: August 22, 2000

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Robert M. Kalany, Florence, KY; Ronald W. Schachleiter, Cincinnati, Ohio; and Robert J. Burkhardt, Cincinnati, Ohio.

Signed and Sealed this Sixth Day of November 2001.

PETER VO
*Supervisory Patent Examiner*
Art Unit 3721